US011177563B2

(12) United States Patent
Bermeo et al.

(10) Patent No.: US 11,177,563 B2
(45) Date of Patent: Nov. 16, 2021

(54) LOWER ELEMENT GROUND PLANE APPARATUS AND METHODS FOR AN ANTENNA SYSTEM

(71) Applicant: Naval Information Warfare Center, Pacific, San Diego, CA (US)

(72) Inventors: Dennis G. Bermeo, San Diego, CA (US); Peter S. Berens, San Diego, CA (US); David W. Brock, San Diego, CA (US); Christopher C. Obra, San Diego, CA (US); Jessica L. Watson, Santee, CA (US); Hoin Lim, Lihue, HI (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 112 days.

(21) Appl. No.: 16/541,384

(22) Filed: Aug. 15, 2019

(65) Prior Publication Data

US 2021/0050661 A1 Feb. 18, 2021

(51) Int. Cl.
*H01Q 1/48* (2006.01)
*H01Q 13/18* (2006.01)
*H01Q 1/52* (2006.01)

(52) U.S. Cl.
CPC ..... *H01Q 1/48* (2013.01); *H01Q 1/52* (2013.01); *H01Q 13/18* (2013.01)

(58) Field of Classification Search
CPC ..... H01Q 1/48; H01Q 1/52; H01Q 13/18; H01Q 9/40; H01Q 9/30; H01Q 9/38
See application file for complete search history.

(56) References Cited

U.S. PATENT DOCUMENTS

| | | | |
|---|---|---|---|
| 4,410,893 | A | 10/1983 | Griffee |
| 5,132,698 | A | 7/1992 | Swineford |
| 5,214,432 | A | 5/1993 | Kasevich et al. |
| 5,223,849 | A | 6/1993 | Kasevich et al. |
| 5,523,767 | A | 6/1996 | McCorkle |
| 5,767,814 | A | 6/1998 | Conroy et al. |
| 5,920,278 | A | 7/1999 | Tyler et al. |
| 5,969,663 | A | 10/1999 | Fullerton et al. |
| 6,268,834 | B1 | 7/2001 | Josypenko |
| 6,339,409 | B1 | 1/2002 | Warnagiris |
| 6,369,766 | B1 | 4/2002 | Strickland et al. |
| 6,606,051 | B1 | 8/2003 | Fullerton et al. |
| 6,642,899 | B2 | 11/2003 | Strickland et al. |
| 6,693,600 | B1 | 2/2004 | Elliot |
| 6,882,301 | B2 | 4/2005 | Fullerton |
| 6,933,882 | B2 | 8/2005 | Fullerton |
| 7,030,806 | B2 | 4/2006 | Fullerton |
| 7,109,928 | B1 | 9/2006 | Thiele et al. |
| 7,236,139 | B2 | 6/2007 | Waschenko |
| 7,453,414 | B2 | 1/2008 | Parsche |

(Continued)

*Primary Examiner* — Wei (Victor) Y Chan
(74) *Attorney, Agent, or Firm* — Naval Information Warfare Center, Pacific; Kyle Eppele; Matthew D. Pangallo

(57) ABSTRACT

A lower element ground plane apparatus for maximizing ground plane surface area in an antenna system, the apparatus involving a lower element of a bi-element antenna and an array of monopole antennas coupled with the lower element of the bi-element antenna, the lower element of the bi-element antenna operable as a ground plane for the array of monopole antennas, whereby ground plane surface area is maximized.

6 Claims, 7 Drawing Sheets

(56) References Cited

U.S. PATENT DOCUMENTS

| | | | |
|---|---|---|---|
| RE40,129 | E | 3/2008 | Warnagiris |
| 7,339,542 | B2 | 3/2008 | Lalezari |
| 7,969,378 | B2 | 6/2011 | Bongfeldt et al. |
| 8,228,257 | B2 | 7/2012 | Lalezari |
| 8,400,367 | B2 | 3/2013 | Bongfeldt et al. |
| 8,576,135 | B1 | 11/2013 | Krivokapic |
| 8,736,506 | B1 | 5/2014 | Brock et al. |
| 8,965,276 | B2 | 2/2015 | Bongfeldt et al. |
| 9,246,224 | B2 | 1/2016 | Lalezari |
| 9,882,286 | B1 | 1/2018 | Tonn |
| 2002/0050955 | A1 | 5/2002 | Strickland et al. |
| 2002/0196176 | A1 | 12/2002 | Fullerton |
| 2003/0001769 | A1 | 1/2003 | Fullerton |
| 2003/0018157 | A1 | 1/2003 | Fullerton et al. |
| 2003/0095063 | A1 | 5/2003 | Fullerton |
| 2005/0017884 | A1 | 1/2005 | Fullerton |
| 2005/0017893 | A1 | 1/2005 | Fullerton |
| 2005/0041746 | A1 | 2/2005 | Rosen et al. |
| 2005/0084031 | A1 | 4/2005 | Rosen et al. |
| 2005/0084032 | A1 | 4/2005 | Rosen et al. |
| 2005/0084033 | A1 | 4/2005 | Rosen et al. |
| 2005/0100076 | A1 | 5/2005 | Gazdzinski et al. |
| 2005/0100102 | A1 | 5/2005 | Gazdzinski et al. |
| 2005/0242983 | A1 | 11/2005 | Fullerton |
| 2006/0125707 | A1 | 6/2006 | Waschenko |
| 2006/0220948 | A1 | 10/2006 | Fullerton |
| 2007/0132650 | A1 | 6/2007 | Lalezari |
| 2007/0159408 | A1 | 7/2007 | Parsche |
| 2007/0247371 | A1 | 10/2007 | Kunysz |
| 2009/0121956 | A1* | 5/2009 | Koshiji ..... H01Q 9/285 343/794 |
| 2009/0140921 | A1 | 6/2009 | Bongfeldt et al. |
| 2009/0140939 | A1 | 6/2009 | Bongfeldt et al. |
| 2009/0237314 | A1 | 9/2009 | Lalezari |
| 2011/0006961 | A1 | 1/2011 | Bongfeldt et al. |
| 2011/0151779 | A1 | 6/2011 | Bongfeldt et al. |
| 2012/0188137 | A1 | 7/2012 | Lalezari |
| 2013/0099995 | A1* | 4/2013 | Huang ..... H01P 11/001 343/872 |
| 2013/0106667 | A1* | 5/2013 | Fenn ..... H01Q 1/525 343/793 |
| 2014/0098846 | A1* | 4/2014 | Emmanuel ..... H04B 5/0043 375/224 |
| 2017/0301991 | A1* | 10/2017 | Stratis ..... H01Q 5/22 |

* cited by examiner

LOWER ELEMENT GROUND PLANE APPARATUS AND METHODS FOR AN ANTENNA SYSTEM

FEDERALLY-SPONSORED RESEARCH AND DEVELOPMENT

The United States Government has ownership rights in the subject matter of the present disclosure. Licensing inquiries may be directed to Office of Research and Technical Applications, Naval Information Warfare Center, Pacific, Code 72120, San Diego, Calif., 92152; telephone (619) 553-5118; email: ssc_pac_t2@navy.mil. Reference Navy Case No. 104135.

TECHNICAL FIELD

The present disclosure technically relates to antennas. Particularly, the present disclosure technically relates to apparatuses for increasing efficiency in an antenna system.

BACKGROUND OF THE INVENTION

In the related art, various related art antenna systems have been implemented, such as conical and bi-conical antennas. Referring to FIG. 1, this diagram illustrates, in a top perspective view, a monopole antenna 200, in accordance with the prior art. A related art monopole antenna 200 has an elongated conductor element 201 which is typically mounted normal to a ground plane 202. A driving signal from a transmitter is applied, or, for receiving antennas, an output signal is received between a lower end of the elongated conductor element 201 and the ground plane 202. One end of a monopole antenna feedline (not shown) is typically coupled with a lower end of the monopole antenna; and the other end of the monopole antenna feedline is typically coupled with the ground plane 202, wherein the related art ground plane 202 is typically the Earth. The related art monopole antenna 200 is a resonant antenna, wherein the elongated conductor element 201 functions as an open resonator for radio waves, thereby oscillating with standing waves of voltage and current along its length. Therefore, the length of the elongated conductor element 201 is determined by the wavelength of the radio waves with which the related art monopole antenna 200 is intended to operate. Related art techniques use many monopole antennas 200 in an antenna system, thereby resulting in undue weight, undue volume, and undue complexity. Therefore, a need exists in the related art for decreasing the weight, volume, and complexity of an antenna system having monopole antennas.

SUMMARY OF INVENTION

To address at least the needs in the related art, the present disclosure involves a lower element ground plane apparatus for maximizing ground plane surface area in an antenna system, the apparatus comprising: a lower element of a bi-element antenna; and an array of monopole antennas coupled with the lower element of the bi-element antenna, the lower element of the bi-element operable as a ground plane for the array of monopole antennas, whereby ground plane surface area is maximized, in accordance with an embodiment of the present disclosure.

BRIEF DESCRIPTION OF THE DRAWING(S)

The above, and other, aspects, features, and benefits of several embodiments of the present disclosure are further understood from the following Detailed Description of the Invention as presented in conjunction with the following several figures of the drawings.

Figure 1:
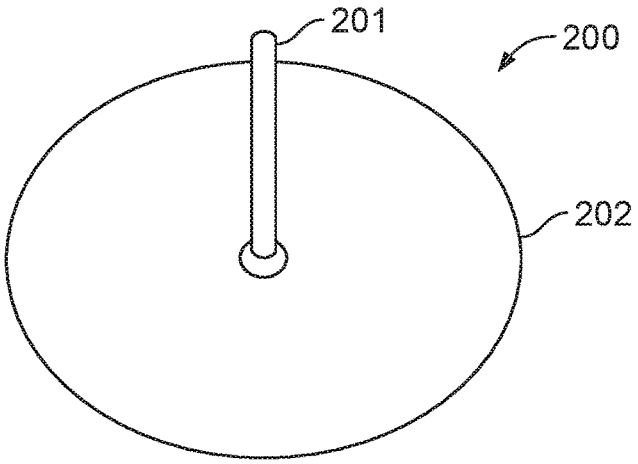
FIG. 1 (PRIOR ART)
FIG. 1 is a diagram illustrating a top perspective view of a monopole antenna, in accordance with the prior art.

Corresponding reference numerals or characters indicate corresponding components throughout the several figures of the drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiment are often not depicted in order to facilitate a less obstructed view of these various embodiments of the present disclosure.

DETAILED DESCRIPTION OF THE EMBODIMENT(S)

In general, the apparatus and methods of the present disclosure use a lower element of a bi-element antenna, such as a bi-cone antenna, as a ground plane for an array of monopole antennas, e.g., in an antenna system. While the bi-element antenna operates at high frequencies, the array of monopole antennas, coupled with the lower element of the bi-element antenna, or other two-element antenna, acting as a ground plane, operates at lower frequencies relative to the operational frequencies of the bi-element antenna, thereby eliminating the related art need for using multiple antenna ground planes. The bi-element antenna comprises at least one of a bi-cone antenna, a bi-conical antenna, an inverse bi-conical antenna, a dish antenna, a bi-dish antenna, an omnidirectional antenna, an omnidirectional antenna system, a spherical antenna, a bi-spherical antenna, an ellipsoidal antenna, a bi-ellipsoidal antenna, a bow-tie antenna, a diamond-shaped antenna, a bi-diamond-shaped antenna, a semi-circular antenna, a bi-semicircular antenna, a circular antenna, a bi-circular antenna, an elliptical antenna, and a bi-elliptical antenna.

Features of the present disclosure include, but are not limited to: sharing a ground plane, thereby eliminating the related art need for multiple ground planes; operating one set of antennas, e.g., the monopole antennas, in one frequency range while operating another antenna, e.g., the bi-element antenna, in another frequency range; optimizing the array of monopole antennas for lower frequency operation while the bi-element antenna operates at a higher frequency range, thereby eliminating the related art need for a diplexer or a frequency divider; operating both the array of monopole antennas and the bi-element antenna in a single aperture; and optimizing an array of monopole antennas or an array of electronics in relation to a desired operating frequency range.

Figure 2:
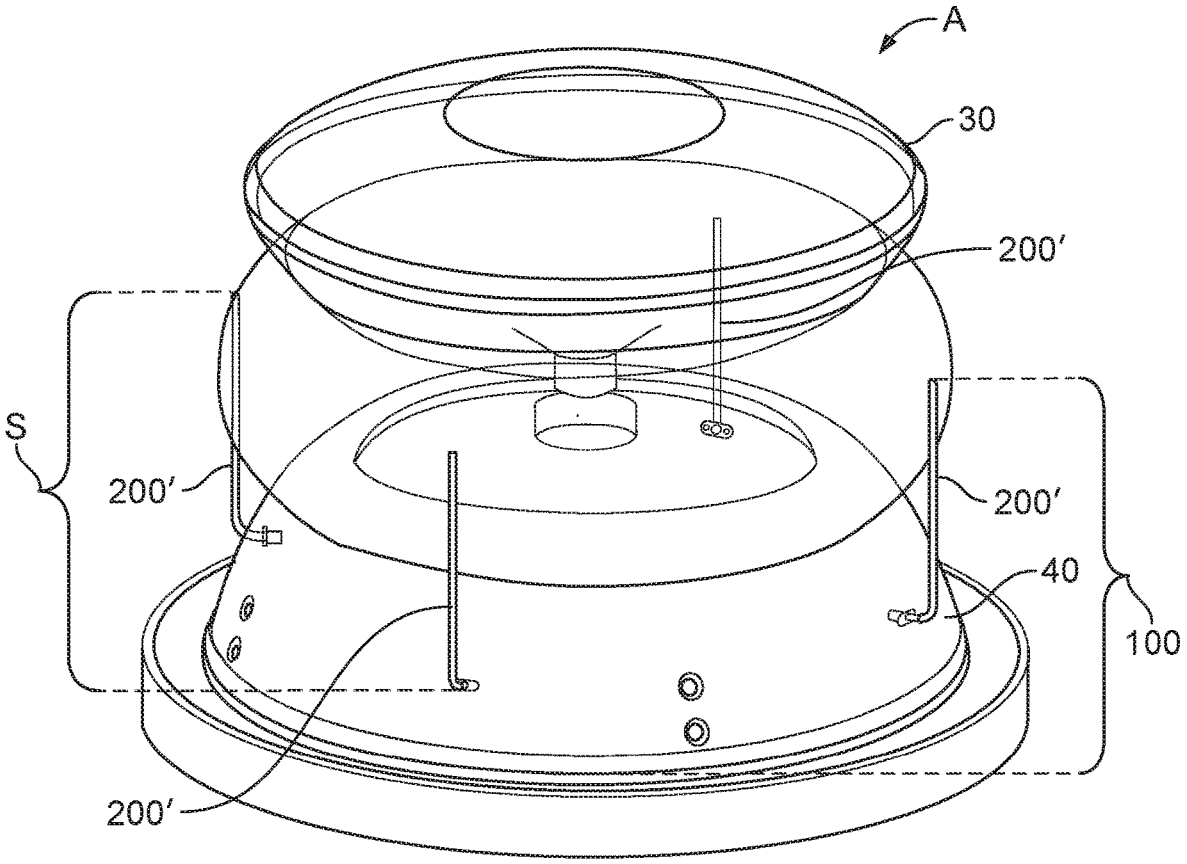
FIG. 2 is a diagram illustrating a perspective view of a lower element ground plane apparatus for maximizing ground plane surface area, operable with an array of monopole antennas, in an antenna system, in accordance with an embodiment of the present disclosure.

Referring to FIG. 2, this diagram illustrates, in a perspective view, a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, with the lower element 40 of the bi-element antenna A operable as a ground plane for the array of monopole antennas 200', whereby ground plane surface area is maximized, in accordance with an embodiment of the present disclosure.

Figure 3:
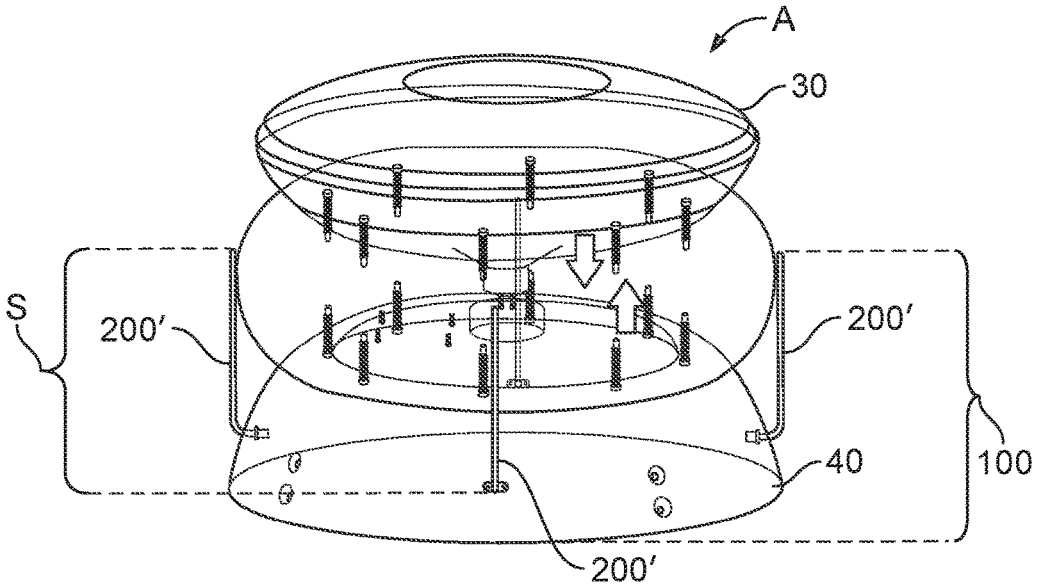
FIG. 3 is a diagram illustrating a general perspective view of a lower element ground plane apparatus for maximizing ground plane surface area in an antenna system, in accordance with an embodiment of the present disclosure.

Referring to FIG. 3, this diagram illustrates, in a general perspective view, a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', whereby ground plane surface area is maximized, in accordance with an embodiment of the present disclosure. In this embodiment, the array of monopole antennas 200' comprises four monopole antennas 200', by example only.

Figure 4:
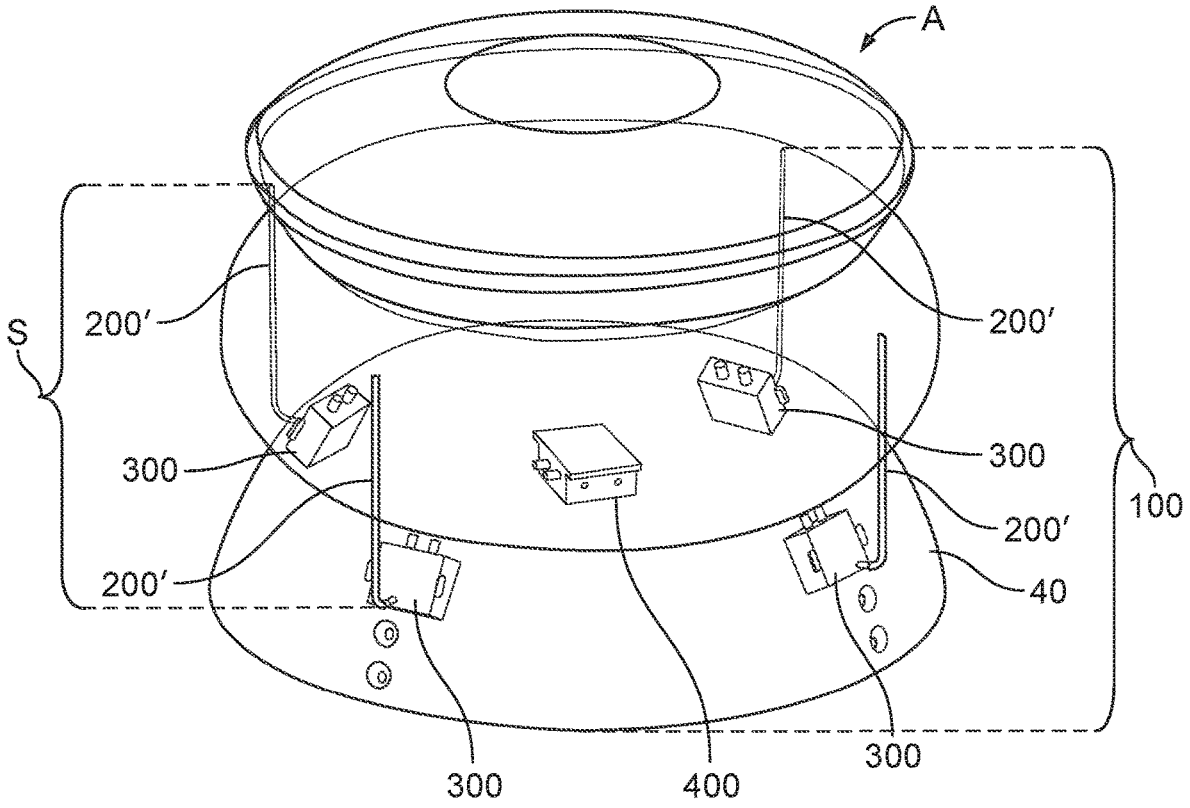
FIG. 4 is a diagram illustrating a detailed perspective view, showing internal components, of a lower element ground plane apparatus for maximizing ground plane surface area in an antenna system, in accordance with an embodiment of the present disclosure.
Figure 9:
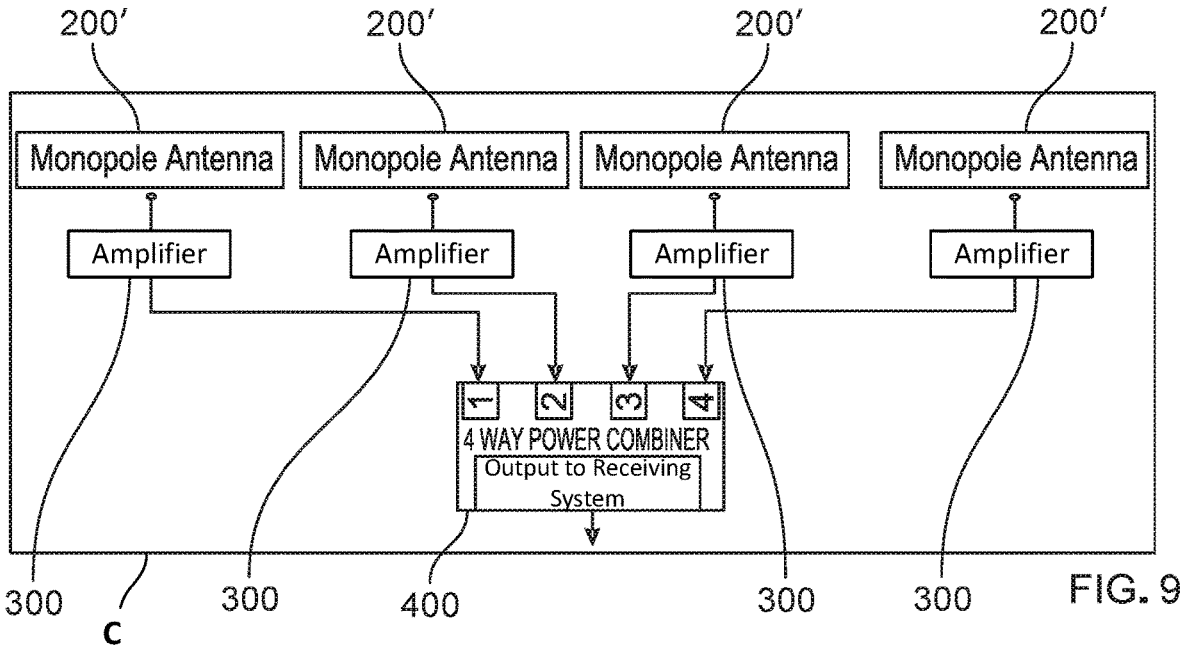
FIG. 9 is a diagram illustrating a circuit topology, comprising a combiner for combining an array of monopole antennas of a bi-element lower element ground plane, in accordance with embodiments of the present disclosure.

Referring to FIG. 4, this diagram illustrates, in a detailed perspective view, showing internal components, a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', whereby ground plane surface area is maximized, as shown in FIG. 2, in accordance with an embodiment of the present disclosure. In this embodiment, the array of monopole antennas 200' comprises four monopole antennas 200', by example only. Various internal components of the antenna system S, such as four corresponding amplifiers and a combiner, such as a four-way combiner, by example only, are shown. By example only, the apparatus A further comprises a plurality of amplifiers 300. Each monopole antenna 200' is correspondingly coupled with each amplifier 300. The apparatus A further comprises a combiner 400 operably coupled with the plurality of amplifiers 300 (FIG. 9). If only one monopole antenna element is coupled with the lower element 40 of the bi-element antenna A, the gain pattern would be distorted; and the overall gain of the antenna system S would be diminished. The antenna system S comprises an array of monopole antennas 200', such as four monopole antennas 200', by example only, to improve gain uniformity, frequency range, and antenna coverage as well as to prevent gain-pattern distortion.

Figure 5:
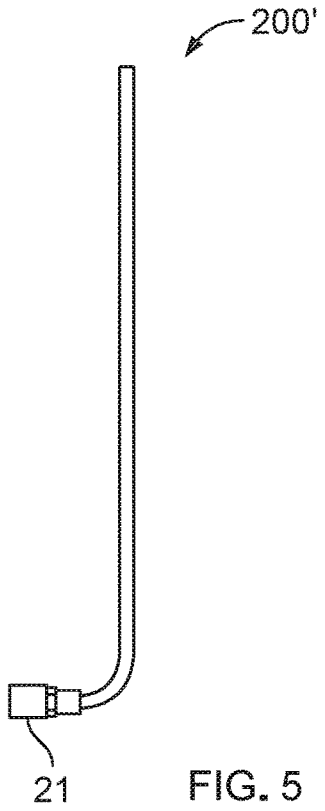
FIG. 5 is a diagram illustrating a side view, of a monopole antenna, in accordance with an embodiment of the present disclosure.

Referring to FIG. 5, this diagram illustrates, in a side view, a monopole antenna 200', in accordance with an embodiment of the present disclosure. The monopole antenna 200' comprises a wire antenna, the wire antenna comprising a center conductor of a semi-rigid coaxial cable, the wire antenna coupled with the lower element 40 of the bi-element antenna A by way of a bulkhead connector 21, by example only. For example, wire antenna comprises a semi-rigid coaxial cable having its outer conductor being removed to expose its center conductor.

Figure 6:
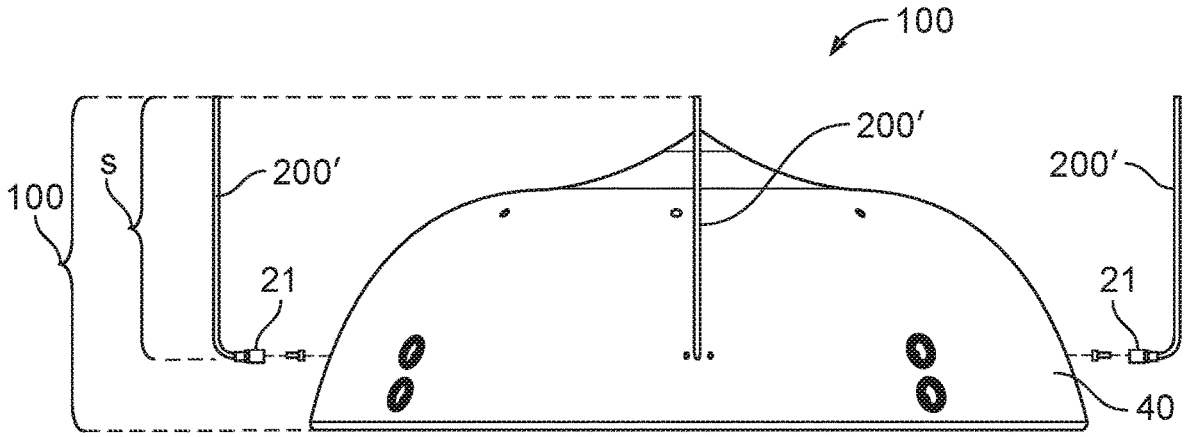
FIG. 6 is a diagram illustrating a side view of an array of monopole antennas coupled with a lower element of a bi-element antenna, in accordance with an embodiment of the present disclosure.

Referring to FIG. 6, this diagram illustrates, in a side view, an array of monopole antennas 200' coupled with a lower element 40 of two-element antenna, such as a bi-element antenna A, in accordance with an embodiment of the present disclosure. The antenna system S comprises an array of monopole antennas 200', such as four monopole antennas 200', by example only. Each monopole antenna 200' is coupled with the lower element 40 of the bi-element antenna A by way of the bulkhead connector 21, as shown in FIG. 5, by example only. The fourth monopole antenna 200' is not shown, but the fourth monopole antenna 200' is understood as being disposed on an opposite side of the monopole antenna 200' that is shown in the middle of FIG. 6. The fields from all four monopole antennas 200' are combined, in phase, to create one antenna pattern.

Figure 7:
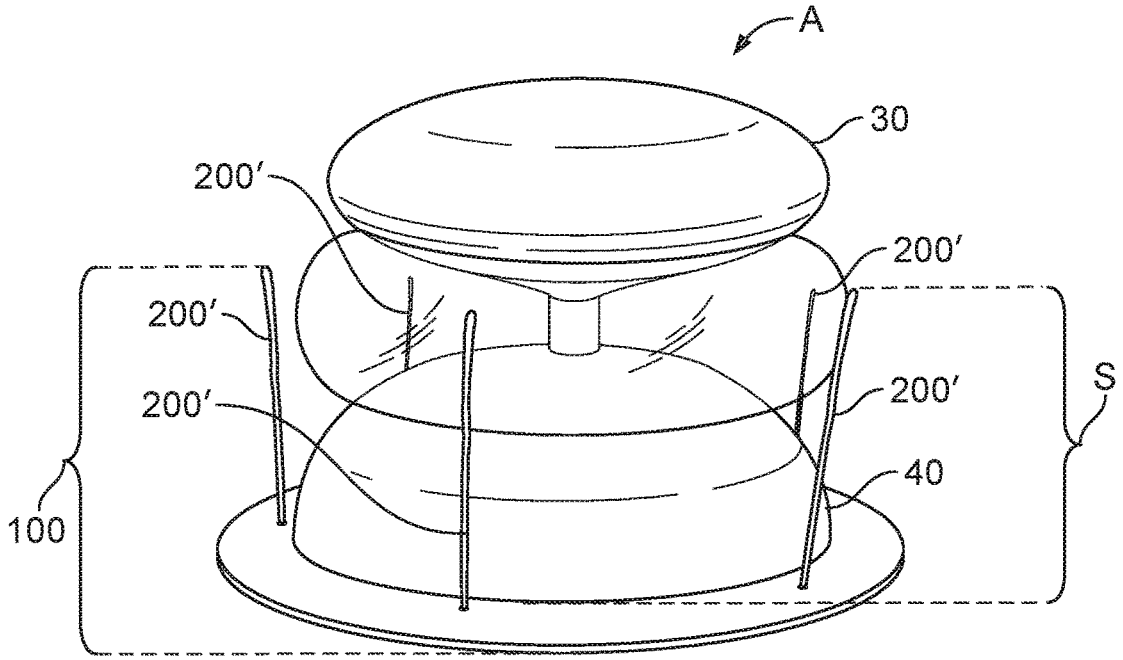
FIG. 7 is a diagram illustrating a side perspective view of a lower element ground plane apparatus for maximizing ground plane surface area in an antenna system, in an example first prototype, in accordance with an embodiment of the present disclosure.

Referring to FIG. 7, this diagram illustrates, in a side perspective view, a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', whereby ground plane surface area is maximized, in an example first prototype, in accordance with an embodiment of the present disclosure.

Figure 8:
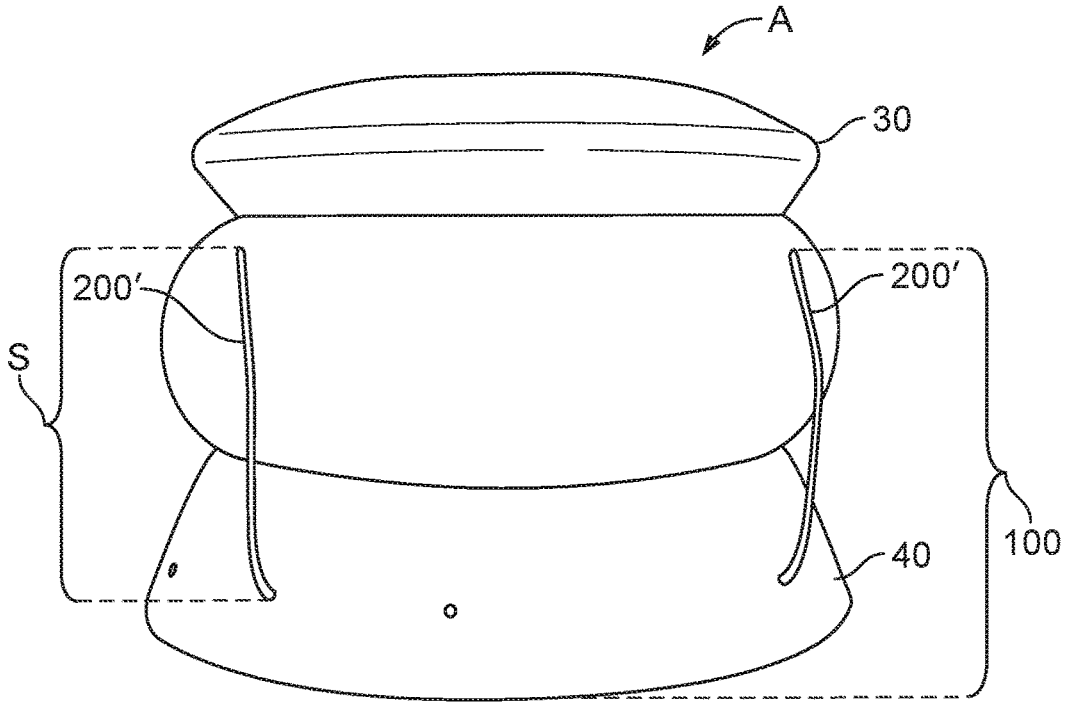
FIG. 8 is a diagram illustrating a side perspective view of a lower element ground plane apparatus for maximizing ground plane surface area in an antenna system, in an example second prototype, in accordance with embodiments of the present disclosure.

Referring to FIG. 8, this diagram illustrates, in a side perspective view, a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', whereby ground plane surface area is maximized, in an example second prototype, in accordance with an embodiment of the present disclosure.

Referring to FIG. 9, this diagram illustrates a circuit topology C, comprising a combiner 400 for combining an array of monopole antennas 200' of a lower element ground plane apparatus 100, in accordance with an embodiment of the present disclosure. The combiner 400, e.g., the four-way combiner, combines the array of monopole antennas 200' (FIG. 4). The combiner 400 combines all the energy, e.g., signals, collected (received) from each amplifier 300, e.g., a voltage probe antenna amplifier. The separation between monopole antennas 200' determines the omnidirectionality of an azimuthal antenna pattern for a selected frequency range. If the operational frequency is higher, the antenna system S requires more monopole antennas 200' to obtain the required uniformity of gain pattern. The lower element ground plane apparatus 100 facilitates the antenna system S in operating at lower frequencies, wherein the monopole antennas 200' are at least approximately ten times smaller in relation to the electrical wavelength of the signal; and the separation between monopole antennas 200' is less than approximately 10 times smaller than the electrical wavelength, wherein wavelength=velocity of light/frequency.

Figure 10:
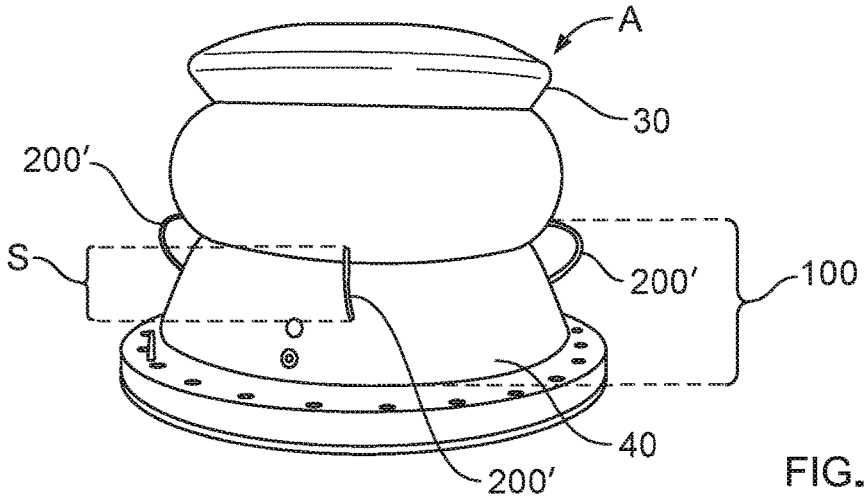
FIG. 10 is a diagram illustrating a lower element ground plane apparatus for maximizing ground plane surface area in an antenna system, in an example third prototype, in accordance with embodiments of the present disclosure.

Referring to FIG. 10, this diagram illustrates a lower element ground plane apparatus 100 for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', wherein the array of monopole antennas 200' are disposed in a curved configuration, whereby ground plane surface area is maximized, in an example third prototype, in accordance with an alternative embodiment of the present disclosure.

Figure 11:
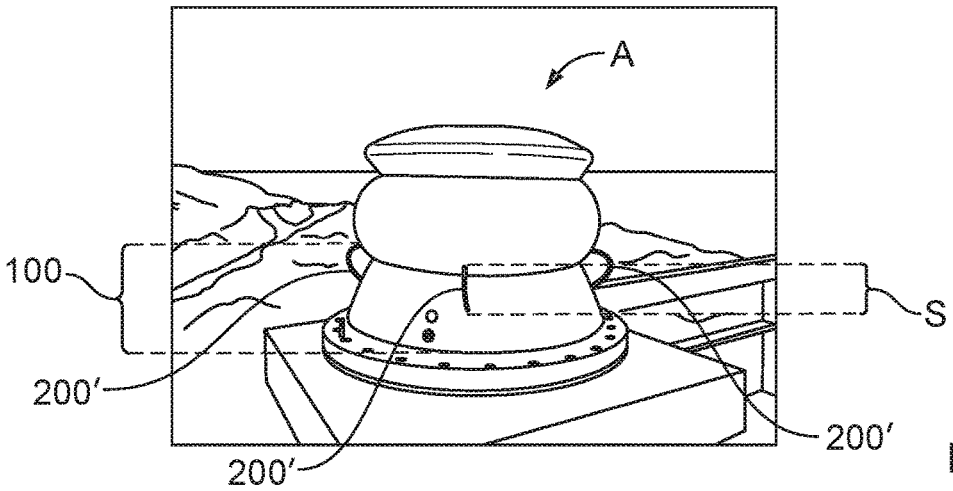
FIG. 11 is a diagram illustrating a lower element ground plane apparatus, as shown in FIG. 10, being field-tested, for maximizing ground plane surface area in an antenna system, in the example third prototype, in accordance with an embodiment of the present disclosure.

Referring to FIG. 11, this diagram illustrates the lower element ground plane apparatus 100, as shown in FIG. 10, being field-tested, for maximizing ground plane surface area in an antenna system S, the apparatus 100 comprising: a lower element 40 of a bi-element antenna A; and an array of monopole antennas 200' coupled with the lower element 40 of the bi-element antenna A, the lower element 40 of the bi-element antenna A operable as a ground plane for the array of monopole antennas 200', wherein the array of monopole antennas 200' are disposed in a curved configuration, whereby ground plane surface area is maximized, in the example third prototype, in accordance with the alternative embodiment of the present disclosure.

Figure 12:
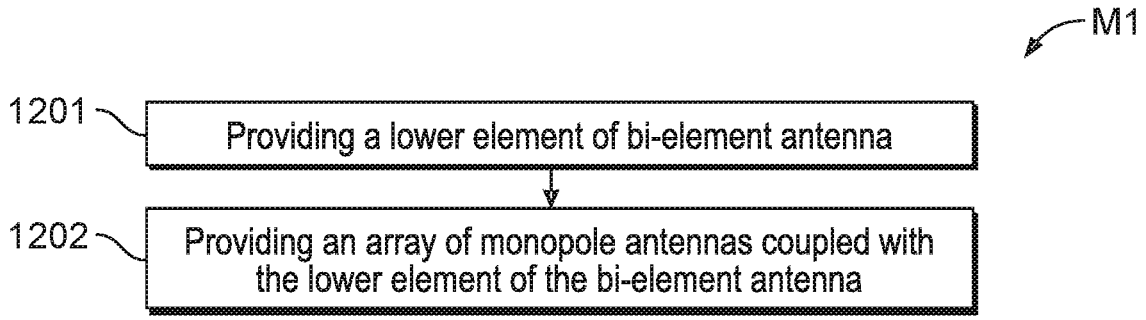
FIG. 12 is a flow diagram illustrating a method of fabricating a lower element ground plane apparatus for maximizing ground plane surface area in an antenna system, in accordance with an embodiment of the present disclosure.

Referring to FIG. 12, this flow diagram illustrates a method M1 of fabricating a lower element ground plane apparatus 100 for maximizing ground plane surface area in an antenna system S, in accordance with an embodiment of the present disclosure. The method M1 comprises: providing a lower element 40 of a bi-element antenna A, as indicated by block 1201; and providing an array of monopole antennas 200' coupled with the lower element 40 of the bi-element antenna A, as indicated by block 1202, whereby ground plane surface area is maximized.

Still referring to FIG. 12, in the method M1, providing the array of monopole antennas 200', as indicated by block 1202, comprises providing at least four monopole antennas 200'. The method M1 further comprises providing the bi-element antenna A, wherein providing the bi-element antenna comprises providing at least one of a bi-cone antenna, a bi-conical antenna, an inverse bi-conical antenna, a dish antenna, a bi-dish antenna, an omnidirectional antenna, an omnidirectional antenna system, a spherical antenna, a bi-spherical antenna, an ellipsoidal antenna, a bi-ellipsoidal antenna, a bow-tie antenna, a diamond-shaped antenna, a bi-diamond-shaped antenna, a semi-circular antenna, a bi-semicircular antenna, a circular antenna, a bi-circular antenna, an elliptical antenna, and a bi-elliptical antenna.

Still referring to FIG. 12, in the method M1, providing the bi-element antenna A comprises providing an amplifier 300 corresponding to each monopole antenna 200' of the array of monopole antennas 200' and providing a combiner 400 operably coupled with each amplifier 300, providing the array of monopole antennas 200', as indicated by block 1202, comprises providing each monopole antenna 200' as a wire antenna, providing each monopole antenna 200' as a wire antenna comprises providing a center conductor of a coaxial cable, providing each monopole antenna 200' as a wire antenna comprises coupling the wire antenna with the lower element 40 of the bi-element antenna A by way of a bulkhead connector 21, and providing the array of monopole antennas 200' comprises disposing the array of monopole antennas 200' in a curved configuration.

Figure 13:
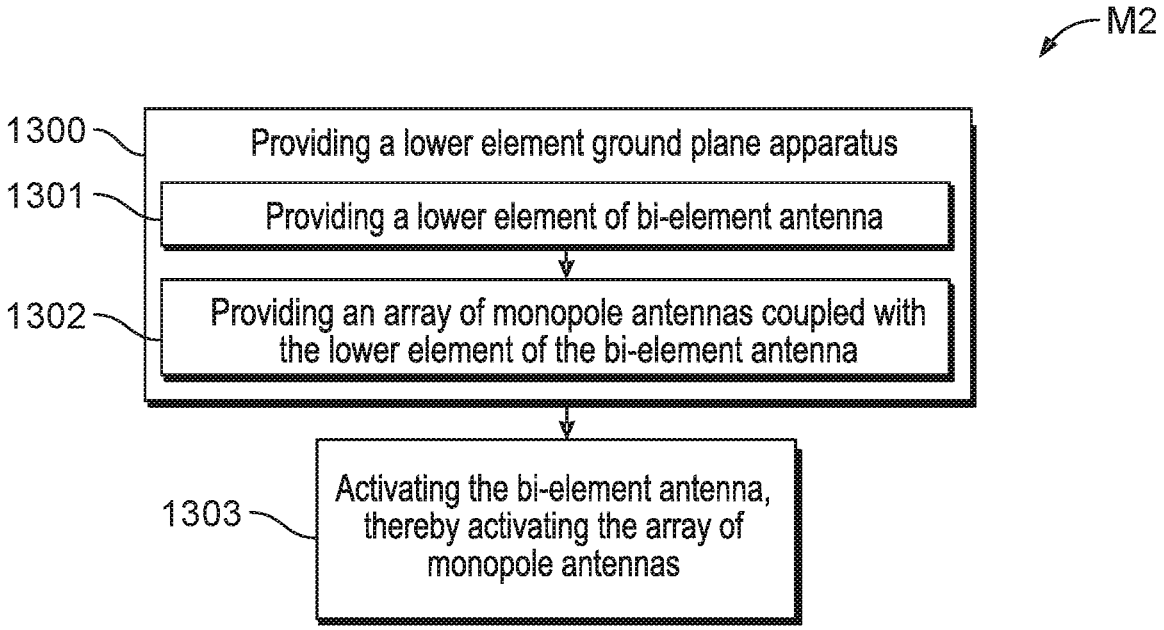
FIG. 13 is a flow diagram illustrating a method of maximizing ground plane surface area in an antenna system by way of a lower element ground plane apparatus, in accordance with an embodiment of the present disclosure.

Referring to FIG. 13, this flow diagram illustrates a method M2 of maximizing ground plane surface area in an antenna system S by way of a lower element ground plane apparatus 100, in accordance with an embodiment of the present disclosure. The method M2 comprises: providing the lower element ground plane apparatus 100, as indicated by block 1300, providing the lower element ground plane apparatus 100 comprising: providing a lower element 40 of a bi-element antenna A, as indicated by block 1301; and providing an array of monopole antennas 200' coupled with the lower element 40 of the bi-element antenna A, as indicated by block 1302; and activating the a bi-element antenna A, thereby activating the array of monopole antennas 200', as indicated by block 1303, thereby maximizing ground plane surface area.

Still referring to FIG. 13, in the method M2, providing the array of monopole antennas 200', as indicated by block 1301, comprises providing at least four monopole antennas 200'. The method M1 further comprises providing the bi-element antenna A, wherein providing the bi-element antenna comprises providing at least one of a bi-cone antenna, a bi-conical antenna, an inverse bi-conical antenna, a dish antenna, a bi-dish antenna, an omnidirectional antenna, an omnidirectional antenna system, a spherical antenna, a bi-spherical antenna, an ellipsoidal antenna, a bi-ellipsoidal antenna, a bow-tie antenna, a diamond-shaped antenna, a bi-diamond-shaped antenna, a semi-circular antenna, a bi-semicircular antenna, a circular antenna, a bi-circular antenna, an elliptical antenna, and a bi-elliptical antenna.

Still referring to FIG. 13, in the method M2, providing the bi-element antenna A comprises providing an amplifier 300 corresponding to each monopole antenna 200' of the array of monopole antennas 200' and providing a combiner 400 operably coupled with each amplifier 300, providing the array of monopole antennas 200', as indicated by block 1302, comprises providing each monopole antenna 200' as a wire antenna, providing each monopole antenna 200' as a wire antenna comprises providing a center conductor of a coaxial cable, providing each monopole antenna 200' as a wire antenna comprises coupling the wire antenna with the lower element 40 of the bi-element antenna A by way of a bulkhead connector 21, and providing the array of monopole antennas 200' comprises disposing the array of monopole antennas 200' in a curved configuration.

Figure 14:
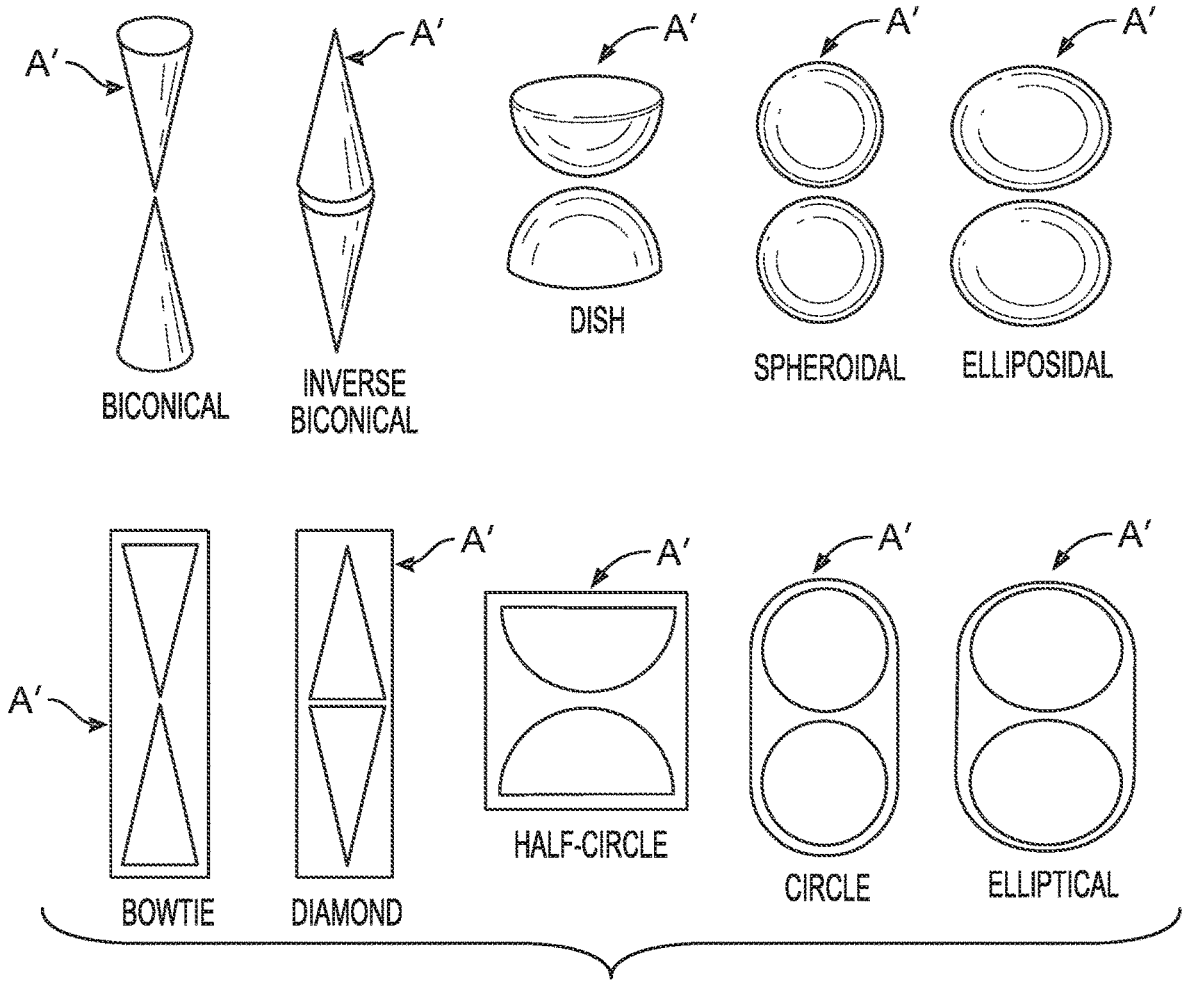
FIG. 14 is a diagram illustrating side views, and cross-sectional side views, of various bi-element antennas, operable with an array of monopole antennas, as shown in FIG. 2, in accordance with various alternative embodiments of the present disclosure.

Referring to FIG. 14, this diagram illustrates side views, and cross-sectional side views, of various bi-element antennas A', operable with an array of monopole antennas 200', as shown in FIG. 2, in accordance with various alternative embodiments of the present disclosure.

It is understood that many additional changes in the details, materials, steps and arrangement of parts, which have been herein described and illustrated to explain the nature of the invention, may be made by those skilled in the art within the principle and scope of the invention as expressed in the appended claims.

What is claimed:

1. A lower element ground plane apparatus for maximizing ground plane surface area in an antenna system, the apparatus comprising:

a lower element of a bi-element antenna; and an array of monopole antennas coupled with the lower element of the bi-element antenna, the lower element of the bi-element antenna operable as a ground plane for the array of monopole antennas;

wherein each individual monopole antenna in the array of monopole antennas is shaped in a semicircular arc configuration and is attached to an outer curved side of the lower element of the bi-element antenna.

2. The apparatus of claim 1, wherein the array of monopole antennas comprises at least four monopole antennas.

3. The apparatus of claim 1, further comprising the bi-element antenna, wherein the bi-element antenna comprises an amplifier corresponding to each monopole antenna of the array of monopole antennas and a combiner operably coupled with each amplifier, and wherein the bi-element antenna consists of at least one of a bi-cone antenna, an inverse bi-conical antenna, an omnidirectional antenna, an omnidirectional antenna system, an ellipsoidal antenna, a bi-ellipsoidal antenna, a bow-tie antenna, a diamond-shaped antenna, a bi-diamond-shaped antenna, an elliptical antenna, and a bi-elliptical antenna.

4. The apparatus of claim 1, wherein each monopole antenna of the array of monopole antennas comprises a wire antenna.

5. The apparatus of claim 4, wherein the wire antenna comprises a center conductor of a coaxial cable.

6. The apparatus of claim 4, wherein the wire antenna is coupled with the lower element of the bi-element antenna by way of a bulkhead connector.

* * * * *